US008765655B2

(12) United States Patent
Yianakopoulos et al.

(10) Patent No.: US 8,765,655 B2
(45) Date of Patent: Jul. 1, 2014

(54) DEGREASING ALL PURPOSE CLEANING COMPOSITIONS AND METHODS

(75) Inventors: Georges Yianakopoulos, Liege (BE); Patricia Pagnoul, Seraing (BE)

(73) Assignee: Colgate-Palmolive Company, New York, NY (US)

( * ) Notice: Subject to any disclaimer, the term of this patent is extended or adjusted under 35 U.S.C. 154(b) by 715 days.

(21) Appl. No.: 12/809,170

(22) PCT Filed: Dec. 18, 2007 (Under 37 CFR 1.47)

(86) PCT No.: PCT/US2007/087884
§ 371 (c)(1), (2), (4) Date: Jun. 18, 2010

(87) PCT Pub. No.: WO2009/078868
PCT Pub. Date: Jun. 25, 2009

(65) Prior Publication Data

US 2011/0105377 A1 May 5, 2011

(51) Int. Cl.

| | |
|---|---|
| ***C11D 1/86*** | (2006.01) |
| ***C11D 1/72*** | (2006.01) |
| *C11D 1/83* | (2006.01) |
| *C11D 1/94* | (2006.01) |
| *C11D 3/20* | (2006.01) |

(52) U.S. Cl.
CPC .. *C11D 1/72* (2013.01); *C11D 1/83* (2013.01); *C11D 1/94* (2013.01); *C11D 3/2082* (2013.01); *C11D 3/2065* (2013.01)
USPC ..... 510/235; 510/365; 510/426; 510/499

(58) Field of Classification Search
CPC ..... C11D 1/94; C11D 1/83; C11D 1/72; C11D 3/2082; C11D 3/2065
USPC ..... 510/235, 365, 426, 499
See application file for complete search history.

(56) References Cited

U.S. PATENT DOCUMENTS

| | | | | |
|---|---|---|---|---|
| 2,503,280 | A | 4/1950 | William | |
| 2,507,088 | A | 5/1950 | Harris | |
| 3,260,744 | A | 7/1966 | Ito | |
| 3,320,174 | A | 5/1967 | Rubinfeld | |
| 3,372,188 | A | 3/1968 | Terence et al. | |
| 3,929,678 | A | 12/1975 | Laughlin et al. | |
| 4,051,058 | A | 9/1977 | Bowing et al. | |
| 4,316,824 | A | 2/1982 | Pancheri et al. | |
| 4,565,647 | A | 1/1986 | Llenado | |
| H468 | H | 5/1988 | Malik et al. | |
| 5,364,551 | A | 11/1994 | Lentsch et al. | |
| 5,677,271 | A | 10/1997 | Bianchetti et al. | |
| 5,720,964 | A | 2/1998 | Murray | |
| 5,786,319 | A | 7/1998 | Pedersen et al. | |
| 5,858,948 | A | 1/1999 | Ghosh et al. | |
| 5,929,007 | A | 7/1999 | Feng | |
| 5,939,378 | A * | 8/1999 | Stringer et al. | 510/503 |
| 6,090,771 | A | 7/2000 | Burt et al. | |
| 6,557,732 | B2 | 5/2003 | Van Rompuy et al. | |
| 6,683,036 | B2 | 1/2004 | Foley et al. | |
| 6,686,325 | B2 | 2/2004 | Hoyt et al. | |
| 6,723,692 | B2 | 4/2004 | Foley et al. | |
| 6,740,628 | B2 | 5/2004 | Bennie et al. | |
| 6,750,187 | B2 | 6/2004 | Alam et al. | |
| 6,787,515 | B2 | 9/2004 | Foley et al. | |
| 6,790,818 | B2 * | 9/2004 | Borgonjon et al. | 510/235 |
| 6,815,405 | B2 * | 11/2004 | Drapier et al. | 510/235 |
| 6,894,013 | B2 * | 5/2005 | Clarke et al. | 510/221 |
| 7,199,094 | B2 | 4/2007 | Cheung et al. | |
| 7,622,436 | B2 | 11/2009 | Tuzi et al. | |
| 7,786,068 | B2 | 8/2010 | Tuzi et al. | |
| 2002/0004469 | A1 * | 1/2002 | Faber | 510/180 |
| 2002/0177539 | A1 * | 11/2002 | Kasturi et al. | 510/235 |
| 2002/0193268 | A1 * | 12/2002 | Embleton et al. | 510/220 |
| 2004/0171504 | A1 | 9/2004 | Clarke et al. | |
| 2004/0254085 | A1 | 12/2004 | Rouillard et al. | |
| 2006/0105931 | A1 * | 5/2006 | Shi et al. | 510/235 |
| 2006/0281653 | A1 | 12/2006 | Hutton et al. | |
| 2007/0086971 | A1 | 4/2007 | Diet et al. | |
| 2007/0123445 | A1 | 5/2007 | Tuzi et al. | |

FOREIGN PATENT DOCUMENTS

| | | |
|---|---|---|
| DE | 735096 | 5/1943 |
| DE | 102006003336 | 7/2007 |
| EP | 0756001 | 1/1997 |
| EP | 0840778 | 5/1998 |
| EP | 1167500 | 1/2002 |
| GB | 2318801 | 5/1998 |
| WO | WO 95/18210 | 7/1995 |
| WO | WO 99/21530 | 5/1999 |
| WO | WO 2009/078867 | 6/2009 |
| WO | WO 2009/078868 | 6/2009 |

OTHER PUBLICATIONS

International Search Report and Written Opinion for PCT/US2007/087884 mailed on Oct. 14, 2008.
International Search Report and Written Opinion for PCT/US2007/087886 mailed on Aug. 18, 2008.

* cited by examiner

*Primary Examiner* — Gregory Webb
(74) *Attorney, Agent, or Firm* — Michael F. Morgan

(57) ABSTRACT

This invention encompasses compositions of surfactant-based products containing anionic and nonionic sufactants, one or more sequestering agents, a glycol solvent for the preparation of liquid cleaning compositions. The surfactant-based product may be any type of cleaning product based on surfactants, which include a sequestering agent. Specifically, the invention relates to a cleaning composition with desirable cleansing properties possessing increased grease cutting.

17 Claims, No Drawings

DEGREASING ALL PURPOSE CLEANING COMPOSITIONS AND METHODS

FIELD OF THE INVENTION

This invention is directed to compositions of surfactant-based products containing one or more sequestering agents for the preparation of liquid cleaning compositions. The cleaning compositions exhibit desirable cleansing properties including increased grease cutting.

BACKGROUND OF THE INVENTION

In formulating cleaning compositions, typically, the cleaning materials are made by diluting liquid or gelled materials to form a use solution. A substantial need exists to manufacture an easily used, excellent soil, e.g., grease, removal properties and controlled foaming. The materials may have some soil removal properties but improving grease removal and hard surface cleaners is a continuing need and requirement. Further, the manufacture of materials that produce useful foam in the presence of large quantities of greasy soil is a continuing challenge for this marketplace.

BRIEF SUMMARY OF THE INVENTION

It has now been found that a cleaning composition can be formulated with one or more anionic surfactants, one or more nonionic surfactants, one or more amine oxides, one or more sequestering agents and one or more glycolic solvents, which possesses increased grease-cutting performance.

To achieve the foregoing and other embodiments and in accordance with the purpose of the present invention, as embodied and broadly described herein the cleaning agent of this invention includes one or more anionic surfactants, one or more nonionic surfactants, one or more amine oxides, one or more sequestering agents and one or more glycolic solvents, which possess increased grease-cutting performance.

Another embodiment of the invention encompasses a grease-cutting cleaning agent including about 0.01% to about 15% of one or more anionic surfactants, about 0.01% to about 10% of one or more nonionic surfactant, about 0.01% to about 10% wt. of one or more amine oxides, about 0.01% to about 10% of one or more sequestering agents, about 0.01% to about 10% of one or more glycol solvents, and optionally containing one or more additional ingredients.

Still another embodiment of the invention encompasses a method of cleaning a surface especially removing grease from a surface, including burnt on grease, which includes contacting the surface with a cleaning agent including one or more anionic surfactants, one or more nonionic surfactants, one or more amine oxides, one or more sequestering agents, one or more glycol solvents, which possess increased grease-cutting performance.

The invention also encompasses a method of making a cleaning composition with superior grease-cutting performance, which includes combining about 0.01% to about 15% of one or more anionic surfactants, about 0.01% to about 10% of one or more nonionic surfactant, about 0.01% to about 10% of one or more amine oxides, about 0.01% to about 10% of one or more sequestering agents, about 0.01% to about 10% of one or more glycol solvents, and optionally containing one or more additional ingredients.

DETAILED DESCRIPTION OF THE INVENTION

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

The present invention relates to a cleaning composition, which includes: wherein the composition surprisingly exhibits improved grease-cutting performance. In various embodiments, the pH is about 7 to about 14, about 8 to about 13 or about 10 to about 12, or 7, about 8, about 9, about 10, about 11, about 12, about 13, or about 14.

Anionic Surfactants

Suitable water-soluble non-soap, anionic surfactants include those surface-active or detergent compounds that contain an organic hydrophobic group containing generally 8 to 26 carbon atoms and in certain embodiments 10 to 1.8 carbon atoms in their molecular structure and at least one water-solubilizing group, which in certain embodiments is sulfonate group.

In certain embodiments, the hydrophobic group may include a $C_8$-$C_{22}$ alkyl, alkyl or acyl group. Such surfactants are employed in the form of water-soluble salts and the salt-forming cation may be sodium, potassium, ammonium, magnesium and mono-, di- or tri-$C_2$-$C_3$ alkanolammonium.

Examples of suitable sulfonated anionic surfactants include higher alkyl mononuclear aromatic sulfonates such as the higher alkyl benzene sulfonates containing 10 to 16 carbon atoms in the higher alkyl group in a straight or branched chain, $C_8$-$C_{15}$ alkyl toluene sulfonates and $C_8$-$C_{15}$ alkyl phenol sulfonates.

In certain embodiments, the sulfonate surfactant is a linear alkyl benzene sulfonate having a high content of 3-(or higher) phenyl isomers and a correspondingly low content (well below 50%) of 2-(or lower) phenyl isomers, that is, wherein the benzene ring is attached in large part at the 3 or higher (for example, 4, 5, 6 or 7) position of the alkyl group and the content of the isomers in which the benzene ring is attached in the 2 or 1 position is correspondingly low. Examples of materials are set forth in U.S. Pat. No. 3,320,174.

Other suitable anionic surfactants include the olefin sulfonates, including long-chain alkene sulfonates, long-chain hydroxyalkane sulfonates or mixtures of alkene sulfonates and hydroxyalkane sulfonates. These olefin sulfonate detergents may be prepared in a known manner by the reaction of sulfur trioxide ($SO_3$) with long-chain olefins containing 8 to 25, or 12 to 21 carbon atoms and having the formula:

$$RCH{=}CHR_1$$

where R is a higher alkyl group of 6 to 23 carbons and $R_1$ is an alkyl group of 1 to 17 carbons or hydrogen to form a mixture of sultones and alkene sulfonic acids which is then treated to convert the sultones to sulfonates. In certain embodiments, the olefin sulfonates contain from 14 to 16 carbon atoms in the R alkyl group and are obtained by sulfonating an $\alpha$-olefin.

Other examples of useful anionic surfactants include, but are not limited to, sodium dioctyl sulfosuccinate [di-(2 ethylhexyl) sodium sulfosuccinate being one] and corresponding dihexyl and dioctyl esters. In certain embodiments, sulfosuccinic acid ester salts are esters of aliphatic alcohols such as saturated alkanols of 4 to 12 carbon atoms and are normally diesters of such alkanols. In other embodiments, alkali metal salts of the diesters of alcohols of 6 to 10 carbons atoms are utilized and in further embodiments, the diesters will be from octanol, such as 2-ethyl hexanol, and the sulfonic acid salt will be the sodium salt.

Other anionic sulfonate surfactants that can be used in the compositions and methods of the invention are paraffin sulfonates containing, in various embodiments, 10 to 20 or 13 to 17 carbon atoms. Primary paraffin sulfonates may be made by reacting long-chain alpha olefins and bisulfites and paraffin sulfonates having the sulfonate group distributed along the paraffin chain are shown in U.S. Pat. Nos. 2,503,280; 2,507,088; 3,260,744; 3,372,188; and German Patent 735,096.

Of the foregoing non-soap anionic sulfonate surfactants, certain illustrative embodiments utilize a magnesium salt of the $C_{13}$-$C_{17}$ paraffin or alkane sulfonates. Another example of a useful anionic surfactant is a sodium salt of $C_{12}$-$C_{13}$ pareth sulfate.

Generally, the proportion of the nonsoap-anionic surfactant will be, in various embodiments, about 0.1 to about 15%, about 0.5 to about 10%, about 1 to about 8%, about 1.1 to about 7%, about 1.2 to about 5%, or about 1.2% by weight of the composition.

Amine Oxides

The compositions of the invention also include at least one amine oxide. The amine oxides are semi-polar nonionic surfactants, which include compounds and mixtures of compounds having the formula:

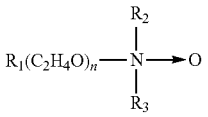

wherein $R_1$ is an alkyl, 2-hydroxyalkyl, 3-hydroxyalkyl, or 3-alkoxy-2-hydroxypropyl radical in which the alkyl and alkoxy, respectively, contain from 8 to 18 carbon atoms, $R_2$ and $R_3$ are each independently methyl, ethyl, propyl, isopropyl, 2-hydroxyethyl, 2-hydroxypropyl, or 3-hydroxypropyl ($R_2$ and $R_3$ may be the same or different); and n is 0 to 10.

In certain embodiments, the compositions of the present invention comprise an amine oxide of the formula:

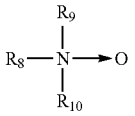

wherein $R_8$ is a $C_{12-16}$ alkyl group or amido radical:

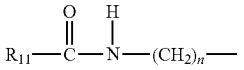

wherein $R_{11}$ is an alkyl group having 9 to 19 carbon atoms and a is an integer of 1 to 4 and $R_9$ and $R_{10}$ are each independently methyl or ethyl. The above ethylene oxide condensates, amides, and amine oxides are more fully described in U.S. Pat. No. 4,316,824, which is hereby incorporated herein by reference. In illustrative embodiments, the amine oxide may be, for example, a lauryol amine oxide, a cocoamido propyl amine oxide, a cocoamido propyl dimethyl amine oxide, a lauryl/myristil amidopropyl diethylamine oxide, a lauryl/myristyl amido propyl amine oxide or a mixture of any of the foregoing.

In various embodiments, the amine oxide is present in an amount of about 0.1 to about 10%, about 0.2 to about 5%, about 0.25 to about 3%, about 0.3% or about 1.1% of the composition.

Nonionic Surfactants

The compositions of the present invention may include nonionic surfactants in addition to the amine oxides discussed above. The water soluble nonionic surfactants useful for the present invention may include aliphatic ethoxylated nonionic surfactants, for example, those that are commercially well known and include the primary aliphatic alcohol ethoxylates and secondary aliphatic alcohol ethoxylates. The length of the polyethenoxy chain can be adjusted to achieve the desired balance between the hydrophobic and hydrophilic elements.

The nonionic surfactant class also may include the condensation products of a higher alcohol (e.g., an alkanol containing about 8 to 16 carbon atoms in a straight or branched chain configuration) condensed with about 4 to about 20 moles of ethylene oxide, for example, lauryl or myristyl alcohol condensed with about 16 moles of ethylene oxide (EO), tridecanol condensed with about 6 to about 15 moles of EO, myristyl alcohol condensed with about 10 moles of EO per mole of myristyl alcohol, the condensation product of EO) with a cut of coconut fatty alcohol containing a mixture of fatty alcohols with alkyl chains varying from 10 to about 14 carbon atoms in length and wherein the condensate contains either about 6 moles of EO per mole of total alcohol or about 9 moles of EO per mole of alcohol and tallow alcohol ethoxylates containing about 6 EO to about 11 EO per mole of alcohol.

Illustrative examples of the foregoing nonionic surfactants include, but are not limited to, the Neodol® or Dobanol® ethoxylates (Shell Co.), which are higher aliphatic, primary alcohol containing 9 to 15 carbon atoms, such as $C_9$-$C_{11}$ alkanol condensed with about 4 to about 10 moles of ethylene oxide (Neodol 91-8®, Dobanol 91-8®, Neodol 91-5®) or about 2.5 moles of ethylene oxide (Neodol 91-2.5® or Dobanol 91-2.5®, $C_{12}$-$C_{13}$ alkanol condensed with about 6.5 moles ethylene oxide (Neodol 23-6.5®), $C_{12}$-$C_{15}$ alkanol condensed with about 12 moles ethylene oxide (Neodol 25-12®), $C_{14}$-$C_{15}$ alkanol condensed with about 13 moles ethylene oxide (Neodol 45-13®), and the like. Such ethoxamers have an HLB (hydrophobic lipophilic balance) value of about 8 to about 15 and give good O/W emulsification, whereas ethoxamers with HLB values below 7 contain less than 4 ethyleneoxide groups and tend to be poor emulsifiers and poor detergents. As used throughout the present disclosure, the trade names "Neodol" and "Dobanol" can be used interchangeably to refer to the same compounds, with the respective trade names used according to the geographies in which they are available.

Additional satisfactory water soluble alcohol ethylene oxide condensates include, but are not limited to, the condensation products of a secondary aliphatic alcohol containing 8 to 18 carbon atoms in a straight or branched chain configuration condensed with 5 to 30 moles of ethylene oxide. Examples of commercially available nonionic detergents of the foregoing type include $C_{11}$-$C_{15}$ secondary alkanol condensed with either 9 EO (Tergitol 15-S-9®) or 12 EO (Tergitol 15-S-12®) marketed by Union Carbide (USA).

The water soluble nonionic surfactants, which can be utilized in this invention, also include aliphatic ethoxylated/propoxylated nonionic surfactants, such as those depicted by the formulas:

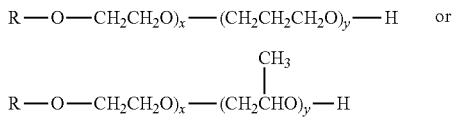

wherein R is a branched chain alkyl group having about 10 to about 16 carbon atoms, or an isotridecyl group and x and y are independently numbered from 0 to 20. In certain embodiments, the ethoxylated/propoxylated nonionic surfactant is Plurafac®300 manufactured by BASF (New Jersey, USA).

In various embodiments, the compositions of the present invention contain about 0.01% to 10%, or about 0.5% to 6% of an nonionic surfactant.

Sequestrants/Sequestering Agents

The cleaning compositions of the invention may contain an organic or inorganic sequestrant or mixtures of sequestrants (also referred to as "sequestering agents"). In various embodiments, the sequestrant is a sequestrant of metallic cations. Organic sequestrants such as citric acid, the alkali metal salts of nitrilotriacetic acid (NTA), EDTA, alkali metal gluconates, polyelectrolytes such as a polyacrylic acid, and the like can be used in the compositions described herein. In certain embodiments, sequestrants are organic sequestrants such as sodium gluconate due to the compatibility of the sequestrant with the formulation base.

The sequestering agents of the invention may also include an effective amount of a water-soluble organic phosphonic acid alkali metal salt, which has sequestering properties. In certain embodiments, phosphonic acid alkali metal salts include low molecular weight compounds containing at least two anion-forming groups, at least one of which is a phosphonic acid group. Such useful phosphonic acids include mono-, di-, tri- and tetra-phosphonic acids which can also contain groups capable of forming anions under alkaline conditions such as carboxy, hydroxy, thio and the like. Among these are phosphonic acid alkali metal salts having the formulae:

$$N[CH_2PO_3Na_4]_3 \text{ or } C(PO_3Na_4)_2OH.$$

The phosphonic acid may also include a low molecular weight phosphonopolycarboxylic acid such as one having about 2-4 carboxylic acid moieties and about 1-3 phosphonic acid groups. Such acids include 1-phosphono-1-methylsuccinic acid, phosphonosuccinic acid and 2-phosphonobutane-1,2,4-tricarboxylic acid.

Other useful organic phosphonic acid sodium salts include 1-hydroxyethylidene-1,1-diphosphonic acid ($CH_3C(PO_3Na_4)_2OH$) and its sodium salt, available from Monsanto Industrial Chemicals Co., Missouri, USA. as Dequest® 2016, a 58-62% aqueous solution; amino [tri(methylenephosphonic acid)] ($N[CH_2PO_3Na_4]_3$), available from Monsanto as Dequest® 2000, a 50% aqueous solution; ethylenediamine [tetra(methylene-phosphonic acid)] available from Monsanto as Dequest® 2041, a 90% solid acid product; and 2-phosphonobutane-1,2,4-tricarboxylic acid available from Mobay Chemical Corporation, Inorganic Chemicals Division, Pittsburgh, Pa. as Bayhibit AM, a 45-50% aqueous solution. It will be appreciated that, the above-mentioned phosphonic acids can also be used in the form of water-soluble acid salts, particularly the alkali metal salts, such as sodium or potassium; the ammonium salts or the alkylol amine salts where the alkylol has 2 to 3 carbon atoms, such as mono-, di-, or triethanolamine salts. If desired, mixtures of the individual phosphonic acids or their acid salts can also be used. Further useful phosphonic acids are discussed in U.S. Pat. No. 4,051,058, the disclosure of which is incorporated by reference herein. Of the phosphonic acids useful in the present invention, those that do not contain amino groups are preferred, since they produce substantially less degradation of the active chlorine source than do phosphonic acids including amino groups.

Sequestrants of the invention also include materials such as, for example, complex phosphate sequestrants, including sodium tripolyphosphate, sodium hexametaphosphate, and the like, as well as mixtures thereof. Phosphates, the sodium condensed phosphate hardness sequestering agent component functions as a water softener, a cleaner, and a detergent builder. Alkali metal (M) linear and cyclic condensed phosphates commonly have a $M_2O:P_2O_5$ mole ratio of about 1:1 to 2:1 and greater. Typical polyphosphates of this kind are sodium tripolyphosphate, sodium hexametaphosphate, sodium metaphosphate as well as corresponding potassium salts of these phosphates and mixtures thereof. The particle size of the phosphate is not critical, and any finely divided or granular commercially available product can be employed.

Sodium tripolyphosphate is a preferred inorganic hardness sequestering agent for reasons of its ease of availability, low cost, and high cleaning power. Sodium tripolyphosphate acts to sequester calcium and/or magnesium cations, providing water softening properties. It contributes to the removal of soil from hard surfaces and keeps soil in suspension. It has little corrosive action on common surface materials and is low in cost compared to other water conditioners. Sodium tripolyphosphate has relatively low solubility in water (about 14 wt %) and its concentration must be increased using means other than solubility. Typical examples of such phosphates being alkaline condensed phosphates (i.e., polyphosphates) such as sodium or potassium pyrophosphate, sodium or potassium tripolyphosphate, sodium or potassium hexametaphosphate, etc.; carbonates such as sodium or potassium carbonate; borates, such as sodium borate; etc.

Solvents

Typical solvents useful for the present embodiments include aqueous soluble, miscible or immiscible. Solvents can include aliphatic and aromatic hydrocarbons, chlorinated hydrocarbons, alcohols, ether compounds, fluorocarbon compounds, and other similar low molecular weight generally volatile liquid materials.

In certain embodiments, water is not a solvent but when used acts as a diluent or as a dispersing medium for the active materials. These materials can be used in solution or as a miscible mixture or as a dispersion of the solvent in the aqueous liquid. A solvent or cosolvent can be used to enhance certain soil removal properties of this invention. Cosolvents include alcohols and the mono and di-alkyl ethers of alkylene glycols, dialkylene glycols, trialkylene glycols, etc. Alcohols that are useful as cosolvents in this invention include methanol, ethanol, propanol and isopropanol. Particularly useful are the mono and dialkyl ethers of ethylene glycol and diethylene glycol, which have acquired trivial names such as polyglymes, cellosolves, and carbitols. Representative examples of this class of cosolvent include methyl cellosolves, butyl carbitol, dibutyl carbitol, diglyme, triglyme, etc. Nonaqueous liquid solvents can be used for varying compositions of the present invention. These include the higher glycols, polyglycols, polyoxides and glycol ethers.

Suitable substances include glycol solvents (including glycol ethers or glycol acetates) such as, for example, propylene glycol, polyethylene glycol, polypropylene glycol, diethylene glycol monoethyl ether, diethylene glycol monopropyl ether, diethylene glycol monobutyl ether, tripropylene glycol methyl ether, propylene glycol methyl ether (PM), dipropylene glycol methyl ether (DPM), propylene glycol methyl ether acetate (PMA), dipropylene glycol methyl ether acetate (CPMA), propylene glycol n-butyl ether, dipropylene glycol monobutyl ether, ethylene glycol n-butyl ether and ethylene glycol n-propyl ether, and combinations thereof. In certain embodiments, the glycol solvent is propylene glycol n-butyl ether. In certain embodiments, the glycol solvent is dipropylene glycol monobutyl ether.

Other useful solvents include ethylene oxide/propylene oxide, liquid random copolymer such as Synalox® solvent series from Dow Chemical (e.g., Synalox® 50-50B); propylene glycol ethers such as PnB, DPnB and TPnB (propylene glycol mono n-butyl ether, dipropylene glycol and tripropylene glycol mono n-butyl ethers sold by Dow Chemical under the trade name Dowanol.RTM.); and tripropylene glycol mono methyl ether "Dowanol TPM®" from Dow Chemical.

The final ingredient in the inventive cleaning compositions is water. The proportion of water in the compositions generally is in the range of about 35% to 90% or about 50% to 85% by weight of the cleaning composition.

Optional Agents

The compositions may optionally contain one or more additional surfactants such as anionic, amphoteric, zwitterionic, nonionic, cationic, or combinations thereof.

The anionic surfactant may be any of the anionic surfactants known or previously used in the art of aqueous surfactant compositions. Suitable anionic surfactants include, but are not limited to, alkyl sulfates, alkyl ether sulfates, alkaryl sulfonates, alkyl succinates, alkyl sulfosuccinates, N-alkoyl sarcosinates, alkyl phosphates, alkyl ether phosphates, alkyl ether carboxylates, alkylamino acids, alkyl peptides, alkoyl taurates, carboxylic acids, acyl and alkyl glutamates, alkyl isethionates, and alpha-olefin sulfonates, especially their sodium, potassium, magnesium, ammonium and mono-, di- and triethanolamine salts. The alkyl groups generally contain from 8 to 18 carbon atoms and may be unsaturated. The alkyl ether sulfates, alkyl ether phosphates and alkyl ether carboxylates may contain from 1 to 10 ethylene oxide or propylene oxide units per molecule, and in certain embodiments contain 1 to 3 ethylene oxide units per molecule.

Examples of suitable anionic surfactants include sodium and ammonium lauryl ether sulfate (with 1, 2, and 3 moles of ethylene oxide), sodium, ammonium, and triethanolamine lauryl sulfate, disodium laureth sulfosuccinate, sodium cocoyl isethionate, sodium C12-14 olefin sulfonate, sodium laureth-6 carboxylate, sodium C12-15 pareth sulfate, sodium methyl cocoyl taurate, sodium dodecylbenzene sulfonate, sodium cocoyl sarcosinate, triethanolamine monolauryl phosphate, and fatty acid soaps.

The nonionic surfactant can be any of the nonionic surfactants known or previously used in the art of aqueous surfactant compositions. Suitable nonionic surfactants include but are not limited to aliphatic ($C_6$-$C_{18}$) primary or secondary linear or branched chain acids, alcohols or phenols, alkyl ethoxylates, alkyl phenol alkoxylates (especially ethoxylates and mixed ethoxy/propoxy), block alkylene oxide condensate of alkyl phenols, alkylene oxide condensates of alkanols, ethylene oxide/propylene oxide block copolymers, semi-polar nonionics (e.g., amine oxides and phospine oxides), as well as alkyl amine oxides. Other suitable nonionics include mono or dialkyl alkanolamides and alkyl polysaccharides, sorbitan fatty acid esters, polyoxyethylene sorbitan fatty acid esters, polyoxyethylene sorbitol esters, polyoxyethylene acids, and polyoxyethylene alcohols. Examples of suitable nonionic surfactants include coco mono or diethanolamide, coco diglucoside, alkyl polyglucoside, cocamidopropyl and lauramine oxide, polysorbate 20, ethoxylated linear alcohols, cetearyl alcohol, lanolin alcohol, stearic acid, glyceryl stearate, PEG-100 stearate, and oleth 20.

Amphoteric and zwitterionic surfactants are those compounds which have the capacity of behaving either as an acid or a base. These surfactants can be any of the surfactants known or previously used in the art of aqueous surfactant compositions. Suitable materials include but are not limited to alkyl betaines, alkyl amidopropyl betaines, alkyl sulphobetaines, alkyl glycinates, alkyl carboxyglycinates, alkyl amphopropionates, alkyl amidopropyl hydroxysultaines, acyl taurates and acyl glutamates wherein the alkyl and acyl groups have 8 to 18 carbon atoms. Examples include cocamidopropyl betaine, sodium cocoamphoacetate, cocamidopropyl hydroxysultaine, and sodium cocamphopropionate.

The cationic surfactants can be any of the cationic surfactants known or previously used in the art of aqueous surfactant compositions. Suitable cationic surfactants include but are not limited to alkyl amines, alkyl imidazolines, ethoxylated amines, quaternary compounds, and quaternized esters. In addition, alkyl amine oxides can behave as a cationic surfactant at a low pH. Examples include lauramine oxide, dicetyldimonium chloride, and cetrimonium chloride.

Other surfactants which can be utilized in the present invention are set forth in more detail in WO 99/21530, U.S. Pat. Nos. 3,929,678; 4,565,647; 5,720,964; and U.S. Pat. No. 5,858,948. Other suitable surfactants are described in McCutcheon's Emulsifiers and Detergents (North American and International Editions, by Schwartz, Perry and Berch), which is hereby fully incorporated by reference.

While amounts of additional optional surfactant can vary widely, in various embodiments, the amount is generally about 1% to about 80%, about 5% to about 65%, about 6% to about 30% or about 8% to 20% weight based upon the total weight of the composition.

The compositions also optionally include one or more thickeners. Suitable thickeners may be organic or inorganic in nature. The thickener may thicken the composition by either thickening the aqueous portions of the composition, or by thickening the non-aqueous portions of the composition. In certain embodiments, the composition is not an emulsion.

Thickeners can be divided into organic and inorganic thickeners. Organic thickeners include (1) cellulosic thickeners and their derivatives, (2) natural gums, (3) acrylates, (4) starches, (5) stearates, and (6) fatty acid alcohols. Inorganic thickeners include (7) clays, and (8) salts. Some non-limiting examples of cellulosic thickeners include carboxymethyl hydroxyethylcellulose, cellulose, hydroxybutyl methylcellulose, hydroxyethylcellulose, hydroxypropylcellulose, hydroxypropyl methyl cellulose, methylcellulose, microcrystalline cellulose, sodium cellulose sulfate, and the like. Some non-limiting examples of natural gums include acacia, calcium carrageenan, guar, gelatin, guar gum, hydroxypropyl guar, karaya gum, kelp, locust bean gum, pectin, sodium carrageenan, tragacanth gum, xanthan gum, and the like. Some non-limiting examples of acrylates include potassium aluminum polyacrylate, sodium acrylate/vinyl alcohol copolymer, sodium polymethacrylate, and the like. Some non-limiting examples of starches include oat flour, potato starch, wheat flour, wheat starch, and the like. Some non-limiting examples of stearates include methoxy PEG-22/dodecyl glycol copolymer, PEG-2M, PEG-5M, and the like. Some non-limiting examples of fatty acid alcohols include caprylic alcohol, cetearyl alcohol, lauryl alcohol, oleyl alcohol, palm kernel alcohol, and the like. Some non-limiting examples of clays include bentonite, magnesium aluminum silicate, magnesium trisilicate, stearalkonium bentonite, tromethamine magnesium aluminum silicate, and the like. Some non-limiting examples of salts include calcium chloride, sodium chloride, sodium sulfate, ammonium chloride, and the like.

Some non-limiting examples of thickeners that thicken the non-aqueous portions of the composition include waxes such as candelilla wax, carnauba wax, beeswax, and the like, oils, vegetable oils and animal oils, and the like.

The composition may contain one thickener or a mixture of two or more thickeners. In certain embodiments the thickeners do not adversely react with the other components or compounds of the invention or otherwise render the composition of the invention ineffective. It is understood that a person skilled in the art will know how to select an appropriate thickener and control any adverse reactions through formulating.

The amount of thickener present in the composition depends on the desired viscosity of the composition. The composition may have a viscosity from about 100 to about 15,000 centipoise, from about 150 to about 10,000 centipoise, and from about 200 to about 5,000 centipoise as determined using a Brookfield DV-II+rotational viscometer using spindle # 21 @ 20 rpm @ 70.degree. F. Accordingly, to achieve the desired viscosities, the thickener may be present in the composition in an amount from about 0.001 wt. % to about 5 wt. % of the total composition, from about 0.01 wt. % to about 3 wt. %, and from about 0.05 wt. % to about 2 wt. % of the total composition.

Thickeners from said classes of substances are generally available and are obtainable, for example, under the trade names Acusol®820 (methacrylic acid (stearyl alcohol-20 EO) ester-acrylic acid copolymer, 30% strength in water, Rohm & Haas), Dapral®-GT-282-S (alkyl polyglycol ether, Akzo), Deuterol®polymer-11 (dicarboxylic acid copolymer, Schoner GmbH), Deuteron® XG (anionic heteropolysaccharide based on beta-D-glucose, D-manose, D-glucuronic acid, Schoner GmbH), Deuteron®-XN (nonionogenic polysaccharide, Schoner GmbH), Dicrylan® thickener-O (ethylene oxide adduct, 50% strength in water/isopropanol, Pfersse Chemie), EMA®-81 and EMA®-91 (ethylene-maleic anhydride copolymer, Monsanto), thickener-QR-1001 (polyurethane emulsion, 19 21% strength in water/diglycol ether, Rohm & Haas), Mirox®-AM (anionic acrylic acid-acrylic ester copolymer dispersion, 25% strength in water, Stockhausen), SER-AD-FX-1100 (hydrophobic urethane polymer, Servo Delden), Shellflo®S (high molecular weight polysaccharide, stabilized with formaldehyde, Shell) and Shellflo®-XA (xanthan biopolymer, stabilized with formaldehyde, Shell).

In addition to the previously mentioned constituents of the composition, one may also employ normal and conventional adjuvants, provided they do not adversely affect the properties of the detergent. Thus there may be used a cationic antibacterial agent, coloring agents and perfumes; polyethylene glycol, ultraviolet light absorbers such as the Uvinuls, which are products of GAF Corporation; pH modifiers; etc. The proportion of such adjuvant materials, in total will normally not exceed 15% by weight of the composition, and the percentages of illustrative examples of such individual components will be about 5% by weight. Sodium formate or formalin or Quaternium 15 (Dowicil 75) can be included in the formula as a preservative at a concentration of about 0.1 to about 4.0 wt. %.

The composition of the invention may, if desired, also contain other components either to provide additional effect or to make the product more attractive to the consumer. The following are mentioned by way of example: colors or dyes in amounts up to about 0.5% by weight; bactericides in amounts up to about 1% by weight; preservatives or antioxidizing agents, such as formalin, 5-bromo-5-nitro-dioxan-1,3; 5-chloro-2-methyl-4-isothaliazolin-3-one, 2,6-di-tert.butyl-p-cresol, in amounts up to about 2% by weight; pH adjusting agents, such as sulfuric acid or sodium hydroxide, as needed; perfumes or oils in amounts up to about 5% by weight. Furthermore, if opaque compositions are desired, up to about 4% by weight of an opacifier may be added.

The compositions of the present invention have a wide number of applications such as home care applications, industrial and institutional applications.

Examples of home care applications include products such as: home care and industrial and institutional applications, such as laundry detergents; dishwashing detergents (automatic and manual); hard surface cleaners; hand soaps, cleaners and sanitizers; polishes (shoe, furniture, metal, etc.); automotive waxes, polishes, protectants, and cleaners, and the like.

The present cleaning compositions are readily made by simple mixing methods from readily available components which, on storage, do not adversely affect the entire composition. Solubilizing agent such as ethanol, hexylene glycol, sodium chloride and/or sodium xylene or sodium xylene sulfonate may be used to assist in solubilizing the surfactants. Because the compositions as prepared in certain embodiments are aqueous liquid formulations and since no particular mixing is required to form them, the compositions are easily prepared simply by combining all the ingredients in a suitable vessel or container. The order of mixing the ingredients is not particularly important and generally the various ingredients can be added sequentially or all at once or in the form of aqueous solutions of each or all of the surfactants can be separately prepared and combined with each other. It is not necessary to use elevated temperatures in the formation step and room temperature is sufficient.

The viscosity of the composition desirably will be at least 100 centipoise (cps) at room temperature, but may be up to 1,000 centipoise as measured with a Brookfield Viscometer using a number 21 spindle rotating at 20 rpm. The viscosity of the light duty liquid composition may approximate those of commercially acceptable light duty liquid compositions now on the market. The viscosity of the composition itself remains stable on storage for lengthy periods of time, without color changes or settling out of any insoluble materials. The pH of the composition can be adjusted by the addition of a base such as $Na_2O$ (caustic soda) to the composition.

The following examples illustrate liquid cleaning compositions of the described invention. Unless otherwise specified, all percentages are by weight. The exemplified compositions are illustrative only and do no limit the scope of the invention. Unless otherwise specified, the proportions in the examples and elsewhere in the specification are by weight. It will be understood by those of skill in the art that numerous and various modifications can be made without departing from the spirit of the present invention. Therefore, it should be clearly understood that the forms of the present invention described herein are illustrative only and are not intended to limit the scope of the invention.

Various embodiments of the present invention are further illustrated in the following non-limiting Example.

Example

The Example illustrates cleaning properties of Formulation 1, a formulation according to the present invention, as compared to a Control.

Formulation 1

| Ingredients | Formulation 1 (wt. %) |
|---|---|
| Sodium $C_{12}$-$C_{13}$ Pareth Sulfate | 1.2 |
| Lauryl/Myristyl amidopropylene diethylene amine oxide | 0.3 |
| Dobanol 91-2.5 | 0.3 |
| Dobanol 91-8 | 0.696 |
| Propylene Glycol n-Butyl Ether | 2.5 |
| Dipropylene Glycol monoButyl Ether | 2.5 |
| 1-Hydroxyethylene diphosphonic acid, sodium salt | 0.35 |
| Perfume | 0.33 |
| Water | Bal. |
| pH | 11 |

Control

| Ingredients | Control (wt. %) |
|---|---|
| $C_{14}$-$C_{17}$ Paraffin Sulfonate (anionic surfactant) | 0.5 |
| Cocoamidopropyl betaine (zwitterionic surfactant) | 0.45 |
| Ethanol | 1 |
| Dobanol 91-2.5 | 0.25 |
| Dobanol 91-8 | 1.25 |
| Propylene Glycol n-Butyl Ether | 1 |
| Dipropylene Glycol monoButyl Ether | 2 |
| Sodium Bicarbonate (alkaline builder) | 0.5 |
| Perfume | 0.33 |
| Water | Bal. |
| pH | 8.5 |

The table below compares the auto-active cleaning results on burnt "Bratensauce" of the formula according to the present invention, when compared to the Control. The higher the score, the more efficient the product.

The test was performed according to the following procedure:

1. 4 stainless steel dishes (diameter=5 cm) were soiled with "Bratensauce" (Germany soil by Knorr. Ref. 1.4607) and heated in an oven up to 200 degrees C. for 15 minutes.
2. The dishes were removed from the oven and allowed to cool down at room Temperature for 1 hour before evaluation.
3. The surfaces of the dishes were covered with about 2.5 g of a product according to the present invention, and the dishes were then rinsed with water, and then allowed to dry overnight. 3 oven replicates were generated for each sample, for statistical treatment.
4. Panelists (a total number of 8) were asked to evaluate the surfaces after rinsing, giving scores from 0 (most soiled) to 10 (unsoiled). Results were statistically treated. Results are shown in Table 1.

TABLE 1

| Product | pH | Scores (2 Replicates) | |
|---|---|---|---|
| Composition of Example 1 | 11 | 8.11 | 7.14 |
| Control | 8.5 | 3.16 | 2.26 |

What is claimed is:

1. A cleaning composition comprising:

(i) 1 to 8% by weight of an anionic surfactant;

(ii) 0.5 to 6% by weight of a nonionic surfactant;

(iii) 0.25 to 3% by weight of an amine oxide surfactant;

(iv) a sequestering agent chosen from phosphonic acids having the formulae:

$R_1N[CH_2PO_3Na_2]_2$ or $R_1C(PO_3Na_2)OH$ wherein $R_1$ is -[(lower)alkylene]$N[CH_2PO_3Na_2]_2$ or a third $CH_2PO_3Na_2$ moiety, and $R_2$ is $C_1$-$C_6$ alkyl; a low molecular weight phosphonopolycarboxylic acid having about 2 to about 4 carboxylic acid moieties and about 1-3 phosphonic acid groups; 1-phosphono-1-methylsuccinic acid; phosphonosuccinic acid; 2-phosphonobutane-1,2,4-tricarboxylic acid; 1-hydroxyethylidene-1,1-diphosphonic acid ($CH_3C(PO_3Na_2)_2OH$); a amino [tri(methylenephosphonic acid)]($N[CH_2PO_3Na_2]_3$); ethylenediamine [tetra(methylene-phosphonic acid)]; and 2-phosphonobutane-1,2,4-tricarboxylic, and salts thereof; and (v) a glycol solvent, wherein the composition has a pH of 10 to 12.

2. The composition of claim 1, wherein the anionic surfactant is chosen from alkyl sulfates, alkyl ether sulfates, alkaryl sulfonates, alkyl succinates, alkyl sulfosuccinates, N-alkoyl sarcosinates, alkyl phosphates, alkyl ether phosphates, alkyl ether carboxylates, alkylamino acids, alkyl peptides, alkoyl taurates, carboxylic acids, acyl and alkyl glutamates, alkyl isethionates, and alpha-olefin sulfonates, especially their sodium, potassium, magnesium, ammonium and mono-, di- and triethanolamine salts, and combinations thereof.

3. The composition of claim 2, wherein the anionic surfactant is a sodium salt of $C_{12}$-$C_{13}$ pareth sulfate.

4. The composition of claim 1, wherein the nonionic surfactant is a $C_9$-$C_{11}$ alcohol ethoxylate.

5. The composition of claim 4, wherein the $C_9$-$C_{11}$ alcohol ethoxylate has about 2.5 moles of ethylene oxide.

6. The composition of claim 4, wherein the $C_9$-$C_{11}$ alcohol ethoxylate has about 8 moles of ethylene oxide.

7. The composition of claim 1, wherein the at least one amine oxide surfactant is chosen from surfactants having the formula:

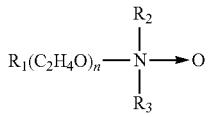

wherein $R_1$ is an alkyl, 2-hydroxyalkyl, 3-hydroxyalkyl, or 3-alkoxy-2-hydroxypropyl radical in which the alkyl and alkoxy each independently contain from 8 to 18 carbon atoms; and $R_2$ and $R_3$ are each independently methyl, ethyl, propyl, isopropyl, 2-hydroxyethyl, 2-hydroxypropyl, or 3-hydroxypropyl; and n is 0 to 10.

8. The composition of claim 7, wherein the amine oxide is a lauryl/myristyl amido propyl amine oxide.

9. The composition of claim 1, wherein the sequestering agent is 1-hydroxyethylene diphosphonic acid or a salt thereof.

10. The composition of claim 1, wherein the glycol solvent is chosen from propylene glycol, polyethylene glycol, polypropylene glycol, diethylene glycol monoethyl ether, diethylene glycol monopropyl ether, diethylene glycol monobutyl ether, tripropylene glycol methyl ether, propylene glycol methyl ether (PM), dipropylene glycol methyl ether (DPM), propylene glycol methyl ether acetate (PMA), dipropylene glycol methyl ether acetate (CPMA), propylene glycol n-butyl ether, dipropylene glycol monobutyl ether, ethylene glycol n-butyl ether and ethylene glycol n-propyl ether, and combinations thereof.

11. The composition of claim 1, wherein the glycol solvent is a combination of propylene glycol n-butyl ether and dipropylene glycol monobutyl ether.

12. The cleaning composition of claim 1, wherein the pH of the cleaning composition is about 11.

13. The cleaning composition of claim 1 comprising:

(i) about 1.2% by weight of one or more anionic surfactants;

(ii) about 0.5 to 6% by weight of one or more nonionic surfactant;

(iii) about 0.3% by weight of one or more amine oxides;

(iv) about 0.01% to 10% of one or more sequestering agents; and (v) about 0.01% to 10% of one or more glycol solvents.

14. A method of cleaning a surface comprising contacting the surface with a cleaning composition of claim 1.

15. A cleaning composition comprising:

a sodium salt of $C_{12}$-$C_{13}$ pareth sulfate, a $C_9$-$C_{11}$ alcohol ethoxylate having about 2.5 moles of ethylene oxide, a $C_9$-$C_{11}$ alcohol ethoxylate having about 8 moles of ethylene oxide, a lauryl/myristyl amido propyl amine oxide, a 1-hydroxyethylene diphosphonic acid salt, and solvent comprising propylene glycol n-butyl ether and dipropylene glycol monobutyl ether.

16. The cleaning composition of claim 15 comprising:

about 1.2% by weight of the sodium salt of $C_{12}$-$C_{13}$ pareth sulfate, about 0.3% by weight of the $C_9$-$C_{11}$ alcohol ethoxylate having about 2.5 moles of ethylene oxide, about 0.7% by weight of the $C_9$-$C_{11}$ alcohol ethoxylate having about 8 moles of ethylene oxide, about 0.3% by weight of the lauryl/myristyl amido propyl amine oxide, about 0.35% by weight of a 1-hydroxyethylene diphosphonic acid sodium salt, and about 2.5% by weight of propylene glycol n-butyl ether, and about 2.5% by weight of dipropylene glycol monobutyl ether.

17. The cleaning composition of claim 16, wherein the composition has a pH of 10 to 12.

* * * * *